United States Patent [19]

Leblanc et al.

[11] Patent Number: 4,669,659

[45] Date of Patent: Jun. 2, 1987

[54] ELECTRICALLY CONTROLLED UNIT FUEL INJECTOR FOR FUEL INJECTION IN DIESEL ENGINES

[75] Inventors: Jean Leblanc, Lyons; Jean Pigeroulet, Villeurbanne; François Rossignol, Mornant, all of France

[73] Assignee: Robert Bosch GmbH, Stuttgart, Fed. Rep. of Germany

[21] Appl. No.: 775,866

[22] Filed: Sep. 13, 1985

[30] Foreign Application Priority Data

Sep. 14, 1984 [DE] Fed. Rep. of Germany ..... 3433710

[51] Int. Cl.[4] ..... F02M 55/00

[52] U.S. Cl. ..... 239/91; 239/95; 239/124

[58] Field of Search ..... 239/88–96, 239/124, 125, 584, 585; 123/458, 506

[56] References Cited

U.S. PATENT DOCUMENTS

| | | | |
|---|---|---|---|
| 4,392,612 | 7/1983 | Deckard et al. | 239/88 |
| 4,540,122 | 9/1985 | Turman | 239/585 X |
| 4,568,021 | 2/1986 | Deckard et al. | 239/88 |

*Primary Examiner*—Joseph F. Peters, Jr.

*Assistant Examiner*—Mary Beth O. Jones

*Attorney, Agent, or Firm*—Edwin E. Greigg

[57] ABSTRACT

The unit fuel injector has a pump piston driven at a constant stroke length, which pumps fuel at injection pressure to an injection nozzle as long as an electrically actuated overflow valve blocks the flow of the fuel flowing from the pump work chamber to a low-pressure chamber via an overflow conduit. The overflow valve is inserted between a first section which communicates continuously with the pump work chamber and a second section leading to the low-pressure chamber of the overflow conduit and is secured to a housing part laterally projecting from the pump housing. The first section of the overflow conduit comprises a connecting bore leading away from the pump work chamber, a control conduit controlled by the overflow valve, and a transverse conduit connecting these two. The transverse conduit extends from the housing side remote from the projecting housing part to the control conduit, crossing through the cylinder bore and in every stroke position of the pump piston is sealed off, without additional sealing means, by the jacket face of the pump piston. The unit fuel injector is particularly suitable for high-pressure injection in Diesel engines.

9 Claims, 2 Drawing Figures

Fig. 1
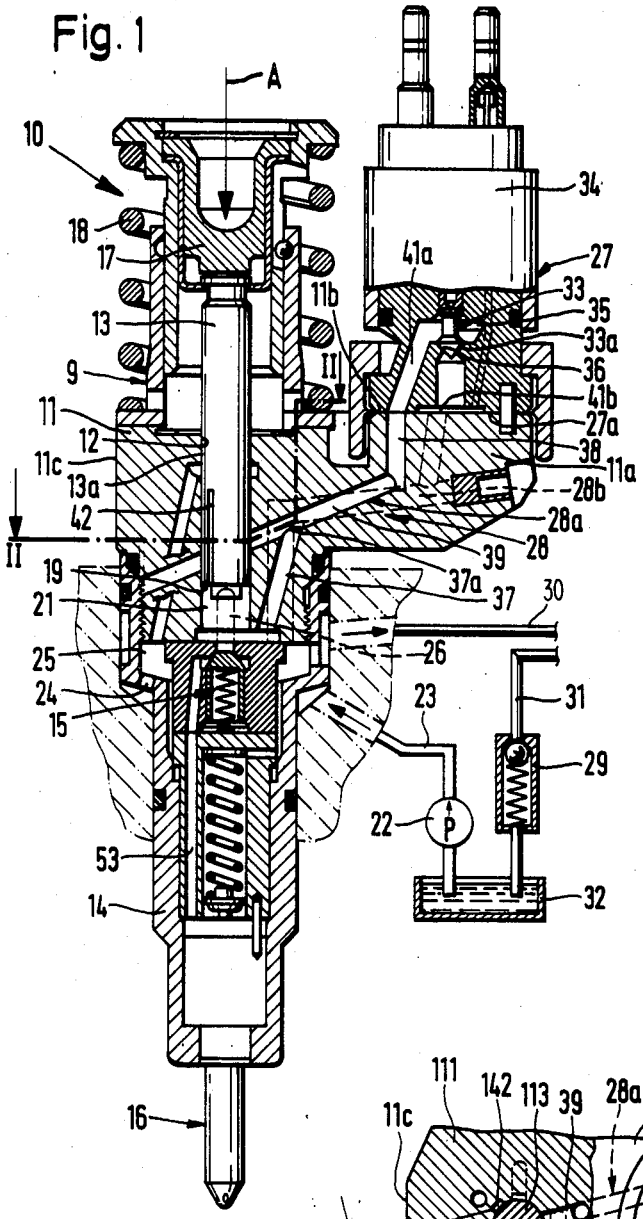
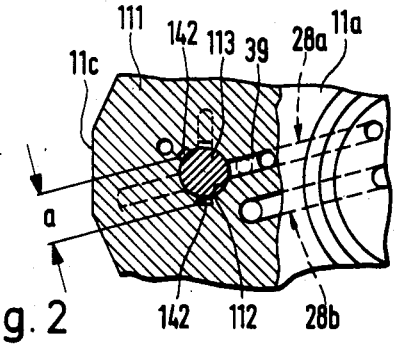
Fig. 2

ELECTRICALLY CONTROLLED UNIT FUEL INJECTOR FOR FUEL INJECTION IN DIESEL ENGINES

BACKGROUND OF THE INVENTION

The invention relates to an electrically controlled unit fuel injector the principles and operation of which will be explained in detail hereinafter. In a unit fuel injector of this kind for Diesel engines, which is known from U.S. Pat. No. 4,392,612 and is built directly into the cylinder head of the associated internal combustion engine includes in a common housing both the mechanically driven piston injection pump and the associated injection nozzle, the fuel injection quantity which is positively displaced out of the pump work chamber to the injection nozzle during the supply stroke of the pump piston is determined by the ON time of an electromagnetically actuated overflow valve that is open when no current is flowing through it. The overflow valve is inserted into an overflow conduit joining the pump work chamber to a low-pressure chamber. The first section of the overflow conduit, which communicates constantly with the pump work chamber, is then subject to the full injection pressure whenever the overflow valve blocks the connection between the two sections of the overflow conduit, and thus the flow of the fuel to the low-pressure chamber, in order to control fuel injection. Because of the very limited amount of available space in the cylinder head of the engine, the overflow valve is secured on a part of the housing that projects laterally from the pump housing at the level of the cylinder bore, and in such an arrangement the first section of the overflow conduit, that is, the section that can be subjected to injection pressure, cannot lead directly from the pump work chamber through to the overflow valve; it takes an angled course instead. This first section of the overflow conduit therefore comprises a connecting bore, offset laterally with respect to the cylinder bore, and a transverse conduit that connects this connecting bore with a control conduit monitored by the overflow valve. In the unit fuel injector known from the above patent, this transverse conduit leads from the outside from an inflow bore on through the laterally projecting housing part, and finally discharges into the connecting bore. The transverse conduit crosses the control conduit, which in this unit fuel injector comprises a control pressure chamber of the overflow valve, and must be sealed off from the outside, toward the inlet, by a sealing plug. Because of the very high injection pressure, in the range of 1000 bar, such sealing plugs mean there is a constant danger of leakage, or else they are destroyed by the high pressures or are forced out of the bore.

OBJECT AND SUMMARY OF THE INVENTION

It is accordingly a principal object of the present invention, in unit fuel injectors of the above generic type, in which a direct connection between the pump work chamber and the overflow valve is not possible for structural reasons, to embody the first section of the overflow conduit that can be placed under injection pressure in such a way that even without sealing plugs, a connection between the pump work chamber and the overflow valve that is simple to establish and provides sealing from the outside is assured.

In the unit fuel injector according to the invention the pump piston, which is fitted into the cylinder bore with a play that is in the range of a few thousandths of a millimeter, provides with its jacket surface the necessary sealing for the transverse conduit that joins the connecting bore, which begins at the pump work chamber, with the control conduit controlled by the overflow valve. Hence no special sealing means are required for the section of the transverse conduit that is isolated by the pump piston, and the transverse conduit can be realized in the form of a simple transverse bore extending across the cylinder bore.

By means of the provisions and characteristics of the narrated herein, further advantageous embodiments and developments of the unit fuel injector revealed in this application are possible. For instance, in a unit fuel injector embodied, which is provided with a flange surface located on the laterally projecting housing part and serving to secure an adjusting member for the overflow valve as in the prior art, in which an end face can be clamped in a pressure-tight manner against the flange surface, the control conduit can be drilled into the laterally projecting housing part in the form of a blind bore, beginning at the flange side and extending as far as a point that communicates with the transverse conduit, in order to avoid impermissibly large idle volumes.

A particularly advantageous embodiment of the subject of the invention is disclosed where the overflow valve, embodied as a structural unit including all the valve components, can be fabricated and tested separately and then subsequently flanged onto the projecting housing part of the unit fuel injector. The two sections of the overflow conduit, which have a very great pressure difference, are sealed off satisfactorily from one another by means of the surfaces that are to be plane-finished in a simple manner and which form a sealing gap, i.e., the flange surface on the projecting housing part and the end face of the overflow valve.

In order to compensate for the shear forces originating in the transverse conduit that is subject to injection pressure and is sealed off from the pump piston jacket face and pressing the pump piston at one end against the wall of the cylinder bore the pressure equalizing grooves can be machined into the jacket face of the pump piston or into the wall of the cylinder bore.

The invention will be better understood and further objects and advantages thereof will become more apparent from the ensuing detailed description of preferred embodiments taken in conjunction with the drawings.

BRIEF DESCRIPTION OF THE DRAWINGS

FIG. 1 is a longitudinal cross section taken through the first exemplary embodiment of a unit fuel injector according to the invention; and FIG. 2 is a fragmentary cross section taken along the line II—II of FIG. 1, but through the second exemplary embodiment of the invention, which has the pressure equalizing grooves in the cylinder bore.

DESCRIPTION OF THE PREFERRED EMBODIMENTS

The first exemplary embodiment, shown in FIG. 1, of an electrically controlled unit fuel injector 10 according to the invention comprises a piston injection pump 9, which is mechanically driven by a camshaft in a manner known per se but not shown, the pump housing 11 of which receives a pump piston 13 that is driven with a constant stroke length and is guided in a cylinder bore 12 and on its end has an injection nozzle 16, of a known type and therefore not otherwise described herein, which is secured by means of a screw liner 14 with a pressure valve 15 being interposed. The pump piston 13 is driven via a pump tappet 17 by known drive means, which are therefore merely indicated by an arrow A, counter to the restoring force of a tappet spring 18. With its end face 19, the pump piston defines a pump work chamber 21 which is located in the cylinder bore 12, is sealed off toward the injection nozzle by the pressure valve 15 and can be made to communicate via a pressure conduit 53 with the injection nozzle 16.

In the outer dead center position, shown, of the pump piston 13, fuel is delivered to the pump work chamber 21 by a feed pump 22 at low inlet pressure, for instance 4 bar. This fuel flows from the feed pump 22 via a supply line 23 and at least one opening 24 in the wall of the screw liner 14 into a low-pressure chamber 25 surrounding the pressure valve 15 inside the screw liner 14 and from there flows via an inlet conduit 26 into the pump work chamber 21. The low-pressure chamber 25 and the pump work chamber 21 also communicate with one another via an overflow conduit 28, which is controllable by an overflow valve 27, in the open position of this valve, shown.

The inlet pressure of the fuel delivered by the feed pump 22 from the low-pressure chamber 25 via the supply line 23 is determined by a pressure limitation valve 29, which is inserted into a return line 31. This return line 31, as part of a ring line 30 leading to the other unit fuel injectors of the same engine, is shown in fragmentary fashion and finally returns the excess fuel to a tank 32.

The overflow valve 27, operating as a 2/2-way valve, is a magnetic valve, which is shown only in partially cutaway form in FIG. 1 in order to illustrate its control function; the special embodiment of this valve is the subject of another patent application.

The overflow valve 27 is embodied as a needle valve, the valve member 33 of which is actuated by an electric adjusting member 34, embodied by an electromagnet, and in the vicinity of its end section remote from the adjusting member 34 it is surrounded by a pressure chamber 35. This pressure chamber 35 can be made to communicate on the one hand, via a first section 28*a* of the overflow conduit 28, continuously with the pump work chamber 21 and on the other hand, via a second section 28*b* of the overflow conduit 28 shown in broken lines in FIG. 1. The open connection between the pressure chamber 35 and the low-pressure chamber 25 shown in FIG. 1 has a conical valve seat 36 at the transition from the pressure chamber 35 to the second section 28*b* of the overflow conduit 28, and this valve seat 36 is closable by a conical closing face 33*a* on the valve member 33.

To enable accommodation of the unit fuel injector 10 in the cylinder head of the Diesel engine without major problems, the overflow valve 27 is secured to a part 11*a* of the housing that protrudes laterally from the pump housing 11 at the level of the cylinder bore 12. Extending into the interior of this housing part 11a is the first section 28*a* of the overflow conduit, that is, the section that begins at the pump work chamber 21. In order to attain the compact structure which is important in terms of the invention, this first section 28*a* comprises a connecting bore 37 that is connected to the pump work chamber 21 and toward the overflow valve 27 is disposed laterally offset with respect to the cylinder bore 12; a control conduit 38 controlled by the overflow valve 27; and a transverse conduit 39 joining this connecting bore 37 to the control conduit 38.

The transverse conduit 39 extends in the form of an oblique connecting bore from the side of the housing marked 11*c*, which is remote from the laterally projecting housing part 11*a*, through the cylinder bore 12 and on to the control conduit 38, intersecting the connecting bore 37; at this point, the transverse conduit 39 and the connecting bore 37 form a discharge point 37*a*. The transverse conduit 39 is arranged such that it crosses through the cylinder bore 12 in a region which in every stroke position of the pump piston 13 is covered by the pump piston jacket face 13*a*. Thus the first section 28*a* of the overflow conduit 28, comprising the connecting bore 37, the control bore 38 and the transverse conduit 39, which section is at injection pressure when the overflow valve 27 is closed, is sealed off by means of the jacket face 13*a* of the pump piston 13, without requiring additional sealing means. The bore 39 is shown extending to the right and left of the piston 13. This is necessary during manufacturing in order to form conduit 39. Otherwise, conduit 39 would be in a blind area with no means of boring the conduit in the housing. The piston 13 seals off the transverse bore 39 so there is no need for an additional plug at the entrance to the cylinder body. Further the screw line 14 extends up over the entrance to bore 39 which also functions as a seal.

Located on the laterally projecting housing part 11*a* is a flange surface 11*b* disposed at right angles to the longitudinal axis of the pump piston 13 and serving to secure the overflow valve 27. One end face 27*a* of the overflow valve 27 is pressed in a pressure-tight manner against this flange surface 11*b*.

The overflow valve 27 is embodied as a structural unit including both the adjusting member 34 and all the valve components, such as the valve member 33, pressure chamber 35 and valve seat 36, and furthermore has connecting conduits 41*a* and 41*b*, discharging at its end face 27*a*, for the two sections 28*a* and 28*b* of the overflow conduit 28. By means of the sealing gap between the flange surface 11*b* on the projecting housing part 11*a* and the end face 27*a* of the overflow valve, which gap assures a metal-to-metal seal, the control conduit 28 is satisfactorily sealed off in the first section 28*a* of the overflow conduit 28 from a partial section of the second section 28*b* of the overflow conduit 28 which is drilled, likewise beginning at the flange surface 11*b*, into the laterally protruding housing part 11*a*. Sealing faces and bores that are readily fabricated are thus obtained in all the structural parts, assuring the satisfactory functioning of the control, effected by the overflow valve 27, of the injection onset and the supply quantity.

To compensate for the shear force exerted upon the pump piston 13 during the injection by the transverse bore 39, which is at injection pressure, the jacket face 13*a* of the pump piston 13 is provided with two pressure equalizing grooves 42 embodied as longitudinal grooves and communicating constantly with the pump work chamber 21. These pressure equalizing grooves 42 are machined into the jacket face 13*a* of the pump piston 13 symmetrically with respect to the longitudinal axis of the transverse conduit, being spaced apart laterally from one another and pointing toward the housing side 11*c* remote from the projecting housing part 11*a*. The distance by which they are spaced apart corresponds to the distance a shown in FIG. 2 for the second embodiment.

The second exemplary embodiment, shown in FIG. 2 in a fragmentary cross section taken along the line II—II of FIG. 1, differs from the first exemplary embodiment shown in FIG. 1 solely in the modified disposition of two pressure equalizing grooves machined into the wall of the cylinder bore. Since only the pump housing and the pump piston are embodied differently, these elements and their modified parts are identified by a reference numeral increased by 100; other components, which are not modified, are identified by the same numerals as in FIG. 1.

Corresponding to the two pressure equalizing grooves 42 in FIG. 1 are the pressure equalizing grooves 142 machined in the form of longitudinal grooves into the wall of the cylinder bore 112 in FIG. 2, being arranged symmetrically with respect to the longitudinal axis of the transverse conduit 39 and spaced apart from one another by a lateral distance a. They are located opposite the part of the transverse conduit 39 that can be subjected to injection pressure; that is, they point toward the housing side 11*c* that is remote from the laterally projecting housing part 11*a*. To assure that these pressure equalizing grooves 142 will always remain in communication with the pump work chamber 21, they must be extended down to the lowest point of the pump work chamber 21.

OPERATION

The mode of operation of the above-described fuel injection pump will now be described, in terms of the exemplary embodiment shown in FIG. 1.

Once the pump piston 13 begins its compression stroke, beginning at its outer dead center position shown in FIG. 1, the fuel delivered to the pump work chamber 21 by the feed pump 22 is forced back into the low-pressure chamber 25, during the first portion of the stroke, both via the inlet conduit 26 and via the overflow conduit 28, which is open when the overflow valve 27 has no current running through it. After the closure of the inlet conduit 26, fuel is positively displaced via the over flow conduit 28 until such time as the overflow valve 27, by means of the valve member 33, closes its valve seat 36 in order to initiate the effective supply onset. The fuel pressure, which now builds up abruptly in the pump work chamber 21, opens the pressure valve 15, and the fuel is pumped via the pressure conduit 53 to the injection nozzle 16. From there, it reaches the combustion chamber of the engine in a known manner.

To terminate fuel supply, the supply of electric current to the adjusting member 34 of the overflow valve 27 is shut off in accordance with operating data ascertained in an electronic regulating unit. The overflow valve 27 is then switched over into its open position shown in FIG. 1. As a result, the pressure in the pump work chamber 21 drops abruptly, and the injection nozzle 16 and the pressure valve 15 close, so that the injection is terminated.

The first section 28*a* of the overflow conduit 28, which is at injection pressure during the fuel injection that takes place when the overflow valve 27 is closed, is sealed off in its middle region, that is, the region embodied by the transverse conduit 39, is sealed off without additional sealing means by the jacket face 13*a* of the pump piston 13, which in accordance with the invention serves as a sealing means; as a result, pump failures that would be caused by excessive leakage of fuel or by a total pressure failure due to destroyed sealing locations are avoided.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. An electrically controlled unit fuel injector for Diesel fuel injection engines, comprising:

a pump housing, a piston injection pump provided with an injection nozzle in said housing;

a reciprocable pump piston guided in a cylinder bore in said housing, said pump piston having a portion confronting a pump work chamber;

said fuel injector further including an electrically actuatable overflow valve and an overflow conduit, said overflow valve inserted between a first section of said overflow conduit which continuously communicates with said pump work chamber and a second section of said overflow conduit, which leads to a low-pressure chamber whereby an otherwise open connection between said first and second sections can be blocked in order to control fuel injection;

said pump housing further including a housing part projecting laterally from said pump housing in proximity to said cylinder bore, said housing part arranged to receive said overflow valve, said first section further including a connecting bore extending from said pump work chamber laterally toward said overflow valve, a further control conduit controlled by said overflow valve and a transverse conduit arranged to connect said connecting bore with said control conduit, said transverse conduit further arranged to extend through said cylinder bore to said control conduit, said transverse conduit further arranged to intersect said connecting bore, and further that said transverse conduit in every stroke position of said pump piston is covered by a jacket face of said piston.

2. A unit fuel injector as defined by claim 1, wherein said laterally projecting housing part further includes a flange surface arranged to receive said overflow valve, said overflow valve having an end face which is positioned in a pressure-tight manner, with said housing part and further wherein said control conduit is drilled as a blind bore in said laterally projecting housing part, beginning at said flange surface, and discharging into said transverse conduit.

3. A unit fuel injector as defined by claim 2, further wherein said overflow valve is embodied as a structural unit comprising an adjusting member and communicating conduits, discharging at said end face of said overflow valve, a seal between said flange surface and said end face of said overflow valve and further wherein said control conduit in said first section of said overflow conduit is sealed off from a partial section of said second section of said overflow conduit, which likewise is drilled into said laterally projecting housing part beginning at said flange surface.

4. A unit fuel injector as defined by claim 1, further wherein at least two pressure equalizing grooves are machined into said jacket face of said pump piston and arranged to communicate with said pump work chamber, said grooves further arranged to extend symmetrically relative to the longitudinal axis of said transverse conduit.

5. A unit fuel injector as defined by claim 2, further wherein at least two pressure equalizing grooves are machined into said jacket face of said pump piston and arranged to communicate with said pump work chamber, said grooves further arranged to extend symmetrically relative to the longitudinal axis of said transverse conduit.

6. A unit fuel injector as defined by claim 3, further wherein at least two pressure equalizing grooves are machined into said jacket face of said pump piston and arranged to communicate with said pump work chamber, said grooves further arranged to extend symmetrically relative to the longitudinal axis of said transverse conduit.

7. A unit fuel injector as defined by claim 1, further wherein at least two pressure equalizing grooves are machined into a wall of said cylinder bore, said grooves arranged to extend symmetrically relative to the longitudinal axis of said transverse conduit said grooves further being laterally spaced apart by a distance from one another and remote from said laterally projecting housing part.

8. A unit fuel injector as defined by claim 2, further wherein at least two pressure equalizing grooves are machined into a wall of said cylinder bore, said grooves arranged to extend symmetrically relative to the longitudinal axis of said transverse conduit said grooves further being laterally spaced apart by a distance from one another and remote from said laterally projecting housing part.

9. A unit fuel injector as defined by claim 3, further wherein at least two pressure equalizing grooves are machined into a wall of said cylinder bore, said grooves arranged to extend symmetrically relative to the longitudinal axis of said transverse conduit said grooves further being laterally spaced apart by a distance from one another and remote from said laterally projecting housing part.

* * * * *